United States Patent [19]

Weisshaupt et al.

[11] Patent Number: 4,976,203

[45] Date of Patent: Dec. 11, 1990

[54] WARHEAD WITH CASING AND LINER FORMING AN INTEGRAL UNIT

[75] Inventors: Herbert P. Weisshaupt, Aachen; Hans Orth, Düsseldorf; Hendrik R. Lips, Düsseldorf; Wilfried Scheideler, Düsseldorf, all of Fed. Rep. of Germany

[73] Assignee: Rheinmetall GmbH, Düsseldorf, Fed. Rep. of Germany

[21] Appl. No.: 447,396

[22] Filed: Dec. 7, 1989

[30] Foreign Application Priority Data

Jan. 7, 1989 [DE] Fed. Rep. of Germany ..... 3900269

[51] Int. Cl.[5] ..... F42B 13/00

[52] U.S. Cl. ..... 102/476; 102/306

[58] Field of Search ..... 102/306–310, 102/476, 491, 493

[56] References Cited

U.S. PATENT DOCUMENTS

| | | | |
|---|---|---|---|
| 2,513,233 | 6/1950 | Byers | 102/306 |
| 4,691,636 | 9/1987 | Witt et al. | 102/476 |

FOREIGN PATENT DOCUMENTS

| | | | |
|---|---|---|---|
| 3424404 | 1/1986 | Fed. Rep. of Germany | 102/476 |
| 1022867 | 3/1953 | France | 102/306 |
| 1604010 | 12/1981 | United Kingdom | 102/476 |

*Primary Examiner*—Charles T. Jordan
*Assistant Examiner*—Rochelle Lieberman
*Attorney, Agent, or Firm*—Spencer & Frank

[57] ABSTRACT

A warhead including a body surrounding an explosive and a projectile forming liner connected to the end of the body. In order to prevent undefined chipping effects along the edge of the liner during detonative reshaping of the liner, the liner and at least the part of the body immediately adjacent the liner form an integral unit made of the same material.

6 Claims, 2 Drawing Sheets

WARHEAD WITH CASING AND LINER FORMING AN INTEGRAL UNIT

BACKGROUND OF THE INVENTION

The present invention relates to a warhead for detonating an explosive, and more particularly to a warhead including a body surrounding the explosive and a projectile forming liner connected to one end of the body.

During the detonative reshaping of liners, undefined chippinq effects are often observed at the edge of the liner, i.e. in the region of the interfaces between liner and projectile body. These effects are particularly grave if liner and projectile body are not made of the same material. The chipping effect interferes with symmetrical tail formation of the projectile during detonative reshaping. Moreover, the mass of the projectile is reduced and thus its kinetic energy is lessened.

To avoid these effects, metal washers, press fits, screw and adhesive connections as well as welded connections for connecting the liner to the projectile body have been used among others in the past. However, none of these measures has brought the desired success.

SUMMARY OF THE INVENTION

It is therefore an object of the present invention to further develop a warhead of the above-mentioned type so that chipping effects of the liner in the region of the interface between liner and projectile body are avoided.

The above and other objects are accomplished according to the invention by the provision of a warhead for detonating an explosive, including: a body surrounding the explosive and having one end; and a projectile forming liner connected to the one end of the body, wherein at least a portion of the body immediately adjacent the liner and the liner form an integral unit and are made of the same material.

Warheads according to the invention have the following advantages:

(1) the sometimes costly means for fastening the liner to the projectile body is eliminated;

(2) the integral unit of liner and projectile body results in an increased release resistance along the edge of the liner; thus the explosive is able to remain in place longer which results in increased initial velocity of the projectile;

(3) if high density materials are employed (e.g. tantalum or tungsten heavy metal), a further increase in initial velocity of the projectile can be realized due to increased tamping while maintaining external dimensions.

BRIEF DESCRIPTION OF THE DRAWINGS

Further details and advantages of the invention will be described below with reference to embodiments that are illustrated in the drawing figures.

DETAILED DESCRIPTION OF THE PREFERRED EMBODIMENTS

Figure 1:
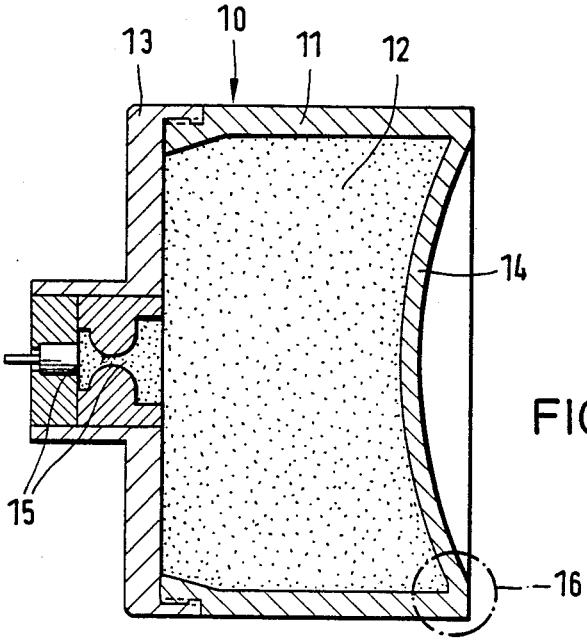
FIG. 1 is a longitudinal sectional view of a warhead according to the invention which is equipped with a projectile forming liner.

In FIG. 1, there is shown a warhead 10 according to the invention which includes a projectile body 11 surrounding an explosive 12. Projectile body 11 is provided at one end with a cover 13 and at the opposite end with a projectile forming liner 14. Explosive 12 of warhead 10 is ignited by way of a transfer and booster charge 15 in a known manner. Reference numeral 16 identifies a transition region between liner 14 and projectile body 11.

According to the invention, liner 14 and at least a portion of projectile body 11 are formed as an integral unit of the same material, such as copper, tungsten, a heavy metal or tantalum. Liner 14 thus ends in a hollow cylindrical portion which constitutes the projectile body 11 of warhead 10. In this way, critical material interfaces in transition region 16 of the liner are avoided.

Due to structurally applied weakened zones in transition region 16 between liner 14 and projectile body 11, as described in greater detail below in reference to FIG. 3, detonative reshaping produces a clean separation between the actual liner 14 and hollow, cylindrical projectile body 11.

Figure 2:
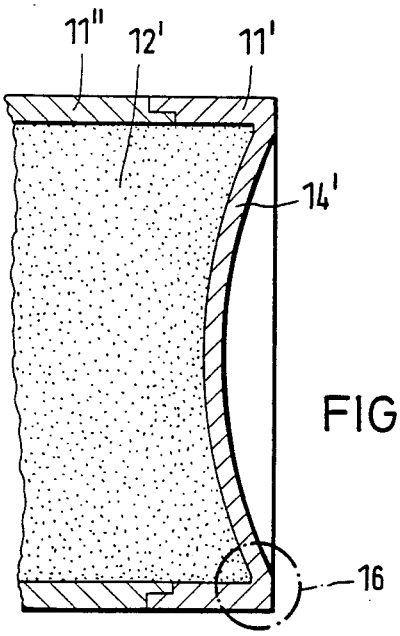
FIG. 2 is a partial longitudinal sectional view of a warhead according to a further embodiment of the invention.

FIG. 2 shows an embodiment of the invention in which only a part of the projectile body forms a unit with the liner instead of the entire projectile body. The body part which forms a unit with the liner is here marked 11' and the remainder of the body is marked 11', the explosive is 12' and the projectile forming liner is marked 14'. The separation during detonative reshaping takes place between body portion 11' and liner 14'.

Figure 3:
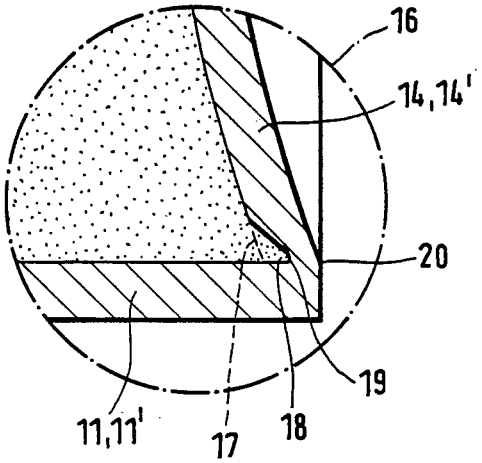
FIG. 3 is an enlarged sectional view of the notched region 16 of FIGS. 1 and 2.

FIG. 3 is an enlarged view of the transition region 16 between liner 14, 14' and body 11, 11'. Here, the numeral 17 identifies the surface of known liners facing the explosive in the region of the outer circumference. According to the present invention, a weakened zone is applied in this region in the form of a notch 18 configured such that a tip 19 of notch 18 lies on the cylindrical continuation of body 11, 11' and is disposed opposite a point 20 on the exterior. Point 20 identifies the air-side transition between the actual projectile forming liner 14, 14' and the cylindrical portion of body 11, 11'.

During an explosive reshaping of liner 14, 14', excessive tension is generated in tip 19 of notch 18 which initiates a crack. This crack then propagates along the connecting line between 19 and 20 and produces a clean separation of the projectile forming liner 14, 14' from body 11, 11'.

The depth of notch 18 depends on the kind of liner material used. It is advisable to make sure that the length of the connecting line between 19 and 20 is 35 percent of the liner thickness 14 for ductile elementary materials, e.g.(copper, iron, or tantalum), or for work hardened materials, such as tungsten heavy metals, a notch depth of 20 percent of the liner thickness is sufficient.

Obviously, numerous and additional modifications and variations of the present invention are possible in light of the above teachings. It is therefore to be understood that within the scope of the appended claims, the invention may be practiced otherwise than a specifically claimed.

What is claimed is:

1. A warhead for denoting an explosive, comprising:

a body surrounding the explosive and having one end; and a projectile forming liner connected to the one end of said body, wherein at least a portion of said body immediately adjacent said liner and said liner form an integral unit and are made of the same material, and said liner includes means for defining weakened zones on its circumference in the region of transition between said liner and said body, said weakened zones producing a clean separation between said liner and said body as a result of detonative reshaping

2. A warhead as defined in claim 1, wherein said liner comprises one of copper, tungsten, a heavy metal and tantalum.

3. A warhead as defined in claim 1, wherein said means comprises a circumferential notch on the side of said liner facing the explosive.

4. A warhead as defined in claim 3, wherein said body comprises a cylindrical body having an inner cylindrical surface, and said notch has one side formed by a continuation of said inner cylindrical surface.

5. A warhead as defined in claim 1, wherein said body comprises a cylindrical body and the entirety of said cylindrical body and said liner form an integral unit made of the same material.

6. A warhead as defined in claim 1, wherein said body comprises a cylindrical body and the portion of said body immediately adjacent said liner has a length in the axial direction which is less than the axial length of said cylindrical body, and said portion is fastened to the remainder of said cylindrical body.

* * * * *